US011197541B1

(12) United States Patent
Fullerton

(10) Patent No.: US 11,197,541 B1
(45) Date of Patent: Dec. 14, 2021

(54) MULTIFUNCTION WORKSTATION AND RELATED METHOD OF USE

(71) Applicant: Chad Fullerton, Bay City, MI (US)

(72) Inventor: Chad Fullerton, Bay City, MI (US)

( * ) Notice: Subject to any disclaimer, the term of this patent is extended or adjusted under 35 U.S.C. 154(b) by 0 days.

(21) Appl. No.: 16/902,942

(22) Filed: Jun. 16, 2020

(51) Int. Cl.
*A47B 21/02* (2006.01)
*A47B 83/00* (2006.01)
*A47B 21/03* (2006.01)
*A47B 13/02* (2006.01)

(52) U.S. Cl.
CPC ..... *A47B 21/02* (2013.01); *A47B 21/03* (2013.01); *A47B 83/001* (2013.01); *A47B 13/02* (2013.01)

(58) Field of Classification Search
CPC ..... A47B 21/02; A47B 21/03; A47B 83/001; A47B 13/02; A47B 13/081; A63B 22/9605; A63B 22/02
USPC ... 108/50.01, 50.02, 20, 102, 105, 137, 143, 108/147
See application file for complete search history.

(56) References Cited

U.S. PATENT DOCUMENTS 2,328,019 A * 8/1943 Jones ..... A47B 17/036 312/194
5,290,058 A * 3/1994 Adams ..... A61G 7/0527 108/143
5,666,888 A * 9/1997 Dame ..... A47B 9/06 108/147.21
6,619,348 B2 * 9/2003 Wang ..... B23D 47/025 108/143
6,817,275 B1 * 11/2004 Chin-Chin ..... B23D 47/025 83/435.11
7,892,148 B1 2/2011 Stauffer et al.
10,499,735 B1 * 12/2019 Cooper ..... A47B 83/045
2012/0160611 A1 * 6/2012 Jech ..... A47F 9/00 186/59
2014/0272848 A1 * 9/2014 Clarke ..... F16L 11/10 434/236
2015/0250304 A1 * 9/2015 Dalebout ..... A63B 71/0686 482/54
2015/0251048 A1 9/2015 Dalebout
2015/0351553 A1 * 12/2015 Herring ..... A47C 7/002 482/54

(Continued)

FOREIGN PATENT DOCUMENTS

CH 404899 A * 12/1965 ..... A47B 21/03
CN 108185662 A * 6/2018
CN 109567386 A * 4/2019

(Continued)

*Primary Examiner* — Janet M Wilkens
(74) *Attorney, Agent, or Firm* — Warner Norcross + Judd LLP

(57) ABSTRACT

A workstation is provided including first and second vertically telescoping support columns, a base frame mounted atop the first and second support columns, so that the base frame is movable up and down, and a desktop joined with the base frame and slidable between a first position in which the desktop is disposed vertically over both the first and second support columns, so a user can sit or stand facing the desktop, and a second position in which the desktop is cantilevered and projects laterally, distally beyond the first support column a first distance beyond the base frame, so that the user can exercise facing the desktop on an exercise device located laterally beyond and outside the first and second support columns. A related method of use is provided.

15 Claims, 5 Drawing Sheets

(56) References Cited

U.S. PATENT DOCUMENTS

| | | | | |
|---|---|---|---|---|
| 2018/0125233 | A1 | 5/2018 | Leier et al. | |
| 2021/0046354 | A1 * | 2/2021 | Oaks | A63B 22/02 |

FOREIGN PATENT DOCUMENTS

| | | | | | |
|---|---|---|---|---|---|
| CN | 110693195 | A | * | 1/2020 | |
| CN | 111134443 | A | * | 5/2020 | |
| DE | 20308213 | U1 | * | 8/2003 | A47B 21/03 |
| EP | 3578085 | A1 | * | 12/2019 | A47B 21/04 |
| GB | 536822 | A | * | 5/1941 | A47B 21/03 |
| KR | 20100009809 | U | * | 10/2010 | |
| KR | 20170087572 | A | * | 7/2017 | |
| WO | WO-2018208206 | A1 | * | 11/2018 | A47C 19/04 |

* cited by examiner

MULTIFUNCTION WORKSTATION AND RELATED METHOD OF USE

BACKGROUND OF THE INVENTION

The present invention relates to a workstation, and more particularly to a desk that can be used in a sitting mode and a standing mode, and can be extended over exercise equipment so that an exercise activity can be conducted while using the desk.

The use of at-home, in residence workstations in recent years has increased due to the acceptance of telecommuting for the performance of employment activities. Many workers who can perform work-related activities for their employer at home often will set up a desk or other work area to perform those activities. Typically, the desk will support various items, such as a computer or tablet, a keyboard, a mouse and pad, one or more monitors, a phone and various office supplies and utensils. Many such desks are relatively simple, having legs that support the work surface in a fixed position.

Often, those who work at home, as well as those in an office environment, will spend a lot of time at their desk. Many such workers, being aware that a sedentary station can cause back problems, poor circulation and reduced productivity, will opt for a desk that is vertically adjustable, so that the work surface can be raised and lowered. The lower position accommodates the worker when seated, and the higher position accommodates the worker when standing.

Some workers take additional efforts to improve their health while at a workstation, and place a mobile treadmill under the desk. The worker will then walk or exercise on the treadmill while performing work-related activities atop the workstation. While this takes some skill and balance, it can enhance the worker's well-being and health. When the worker tires, or wants to convert the desk to a lower seated position, the worker must remove the treadmill, replace it with a chair, and lower the desk to the lower position. This can involve time-consuming movement of the treadmill and chair, and where space is limited, can create issues.

Some desk manufacturers, mindful of the above issues, have made very wide desks with legs separated far apart to enable a treadmill and a chair to both be located under the desk. While this provides improved transition between a seated position and a treadmill utilizing position, the desk can be unusually wide, and difficult to maneuver and place, particularly in smaller or more cramped rooms. The worker also must move all of their work items, such as a display, phone and mouse if the user wants to move from a seated position to a treadmill engaging position at the desk. This can take time, and items can be misplaced in the sideways shuffle of those items.

Accordingly, there remains room for improvement in the field of workstations, and in particular desks for use in multiple positions for workers.

SUMMARY OF THE INVENTION

A workstation is provided including first and second vertical support columns and a desktop joined with the base frame and slidable between a first position in which the desktop is disposed vertically over the support columns, so a user can stand facing the desktop, and a second position in which the desktop is cantilevered and projects laterally beyond the first support column, so that the user can exercise facing the desktop on exercise equipment located laterally beyond and outside the support columns.

In one embodiment, the workstation can include a base frame that is mounted atop the first and second support columns, so that the base frame is movable up and down. The base frame can be coupled to a motorized or manual actuator that can be operated to move the base frame and subsequently the desktop up and down a preselected distance, optionally to a seated position or a standing position so that the user can sit or stand at the desk in those respective positions.

In another embodiment, the desktop can be configured so that at least half or at least ⅔rds of its length cantilevers laterally outward beyond the first support column so that the work space atop the desktop can be preserved, and so that the user need not reorganize or shuffle items on the desktop to accommodate the new position in which a user can engage in an exercise activity while using the work space.

In still another embodiment, the desktop can be coupled to the base frame and configured so that the desktop can cantilever laterally beyond either of the support columns in either direction.

In yet another embodiment, the workstation can be configured to vertically move the desktop when the desktop is laterally displaced in the second or cantilevered position. The desktop thus can be moved to fit at a proper height above or adjacent a piece of exercise equipment, which can be a treadmill, an exercise bike, an elliptical, a stair stepper, a hip swayer or any other type of exercise equipment.

In even another embodiment, the workstation can include a linear rail assembly joined with the base frame and/or the desktop. The linear rail assembly can include one or more rail mounts fixedly joined with the desktop and slidably joined with one or more elongated rails extending adjacent the base frame. The rail mounts can include low friction polymer, bearings, rollers or other friction reducing items to enable the mounts to slide easily on the rails so that the attached desktop also moves easily relative to the rails and base frame when moving to or from the second position to the first position where the desktop is located over the first and second support columns.

In a further embodiment, the workstation can include a motorized actuator joined with the linear rail assembly. The actuator can move the desktop from the second position to the first position and vice versa. The motorized actuator can be any number of actuators, for example a linear actuator, a solenoid actuator, a scissor actuator, a jack screw, a screw actuator, a geared actuator, a magnetic actuator, a pneumatic actuator, a hydraulic actuator or any other type of actuator that facilitates movement of the desktop relative to the support columns.

In still a further embodiment, the actuator immobilizes the desktop when movement of the desktop by the actuator ceases. For example, the actuator can move the desktop to the second position, cantilevered laterally beyond the first support column, at which point the actuator locks movement of the desktop so that the desktop will not move again until the actuator is actuated by a control operated by the user. In this manner, the desktop can be well secured in place in the cantilevered manner, so if the user on the exercise equipment bumps it, the desktop will not move or slide back to the first position over the legs.

In yet a further embodiment, the elongated rails can be cylindrical metal rails with the rail mounts mounted around the outer dimension of the rails, permitting relative sliding of the mounts relative to the rails but preventing the mounts from disengaging the rails when the desktop is cantilevered to the first mode. The rails can be of sufficient weight to counterbalance the extended, cantilevered desktop with a margin of safety to prevent the workstation from tipping if inadvertently overloaded on the extended desktop.

In even a further embodiment, a method of using the workstation is provided including sliding the desktop from a first position in which the desktop is disposed vertically over both the first and second support columns, so that a user can sit or stand facing the desktop at a location between the first and second support columns, to a second position in which the desktop is cantilevered and projects laterally beyond the first support column a first distance beyond the base frame, so that the user can exercise facing the desktop on an exercise equipment located laterally beyond and outside the first and second column supports.

In yet a further embodiment, the method can include sliding greater than 50% of the desktop length laterally beyond in a cantilevered manner the first column support when the desktop is in the second position; and disposing less than 50% of the desktop length between the first support column and the second support column when the desktop is in the second position.

The current embodiments provide an efficient workstation that fulfills a long felt need. The station can include a relatively small footprint, yet allows the desktop to be moved over an exercise equipment piece easily and safely. This movement can be provided while leaving the work area on the desktop relatively untouched, and enabling the user to get to work with minimal disruption after movement to or from different positions. The work area thus can also include a relatively larger dimension so more items can be supported thereon. Where the desktop can be lowered to a seated position, the workstation allows exercise equipment to be left in place adjacent the support columns without creating height adjustment limitations because the desktop clears the equipment easily. In turn, a user need not exert themselves to periodically remove such equipment from under the desktop. The desktop and support columns also can be configured so various items, such as a desktop computer, audio components, file cabinets, refuse receptacles, and the like, can be placed under the desktop and any base frame without interference with a user's legs.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

Figure 1:
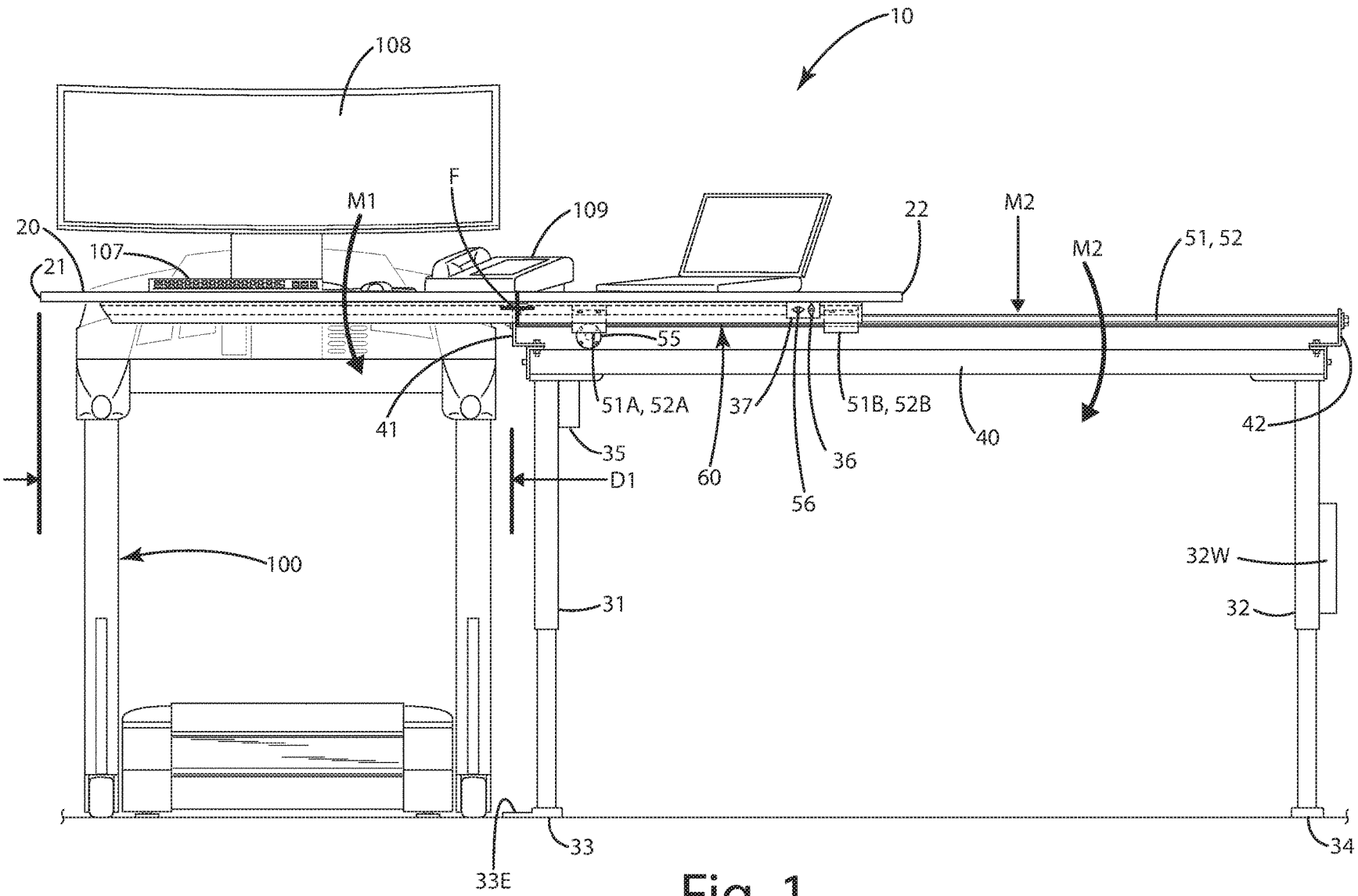
FIG. 1 is a perspective view of the workstation of a current embodiment in a upwardly and laterally extended first mode.
Figure 2:
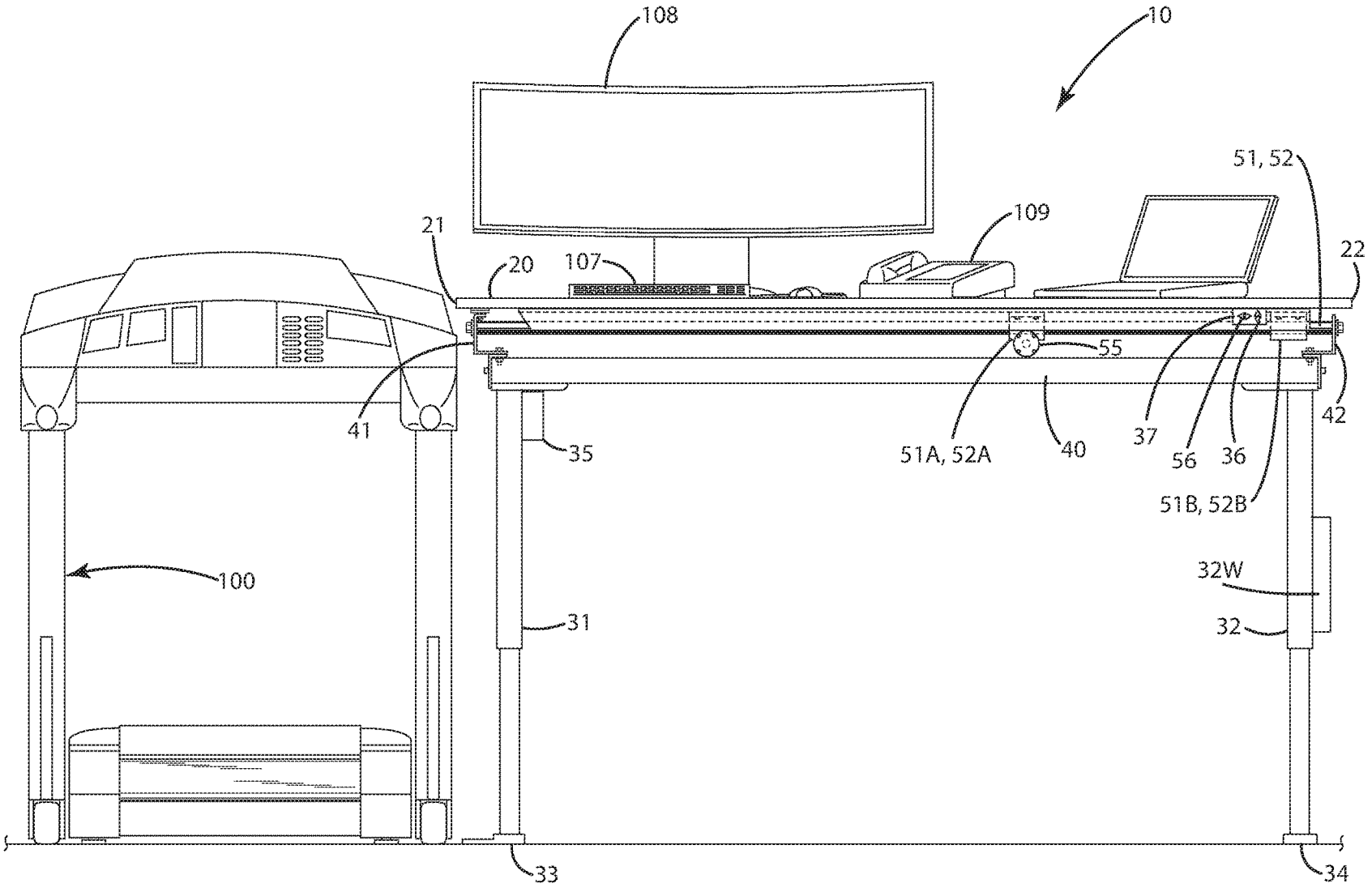
FIG. 2 is a perspective view of the workstation in an upwardly extended non-laterally extended second mode.
Figure 3:
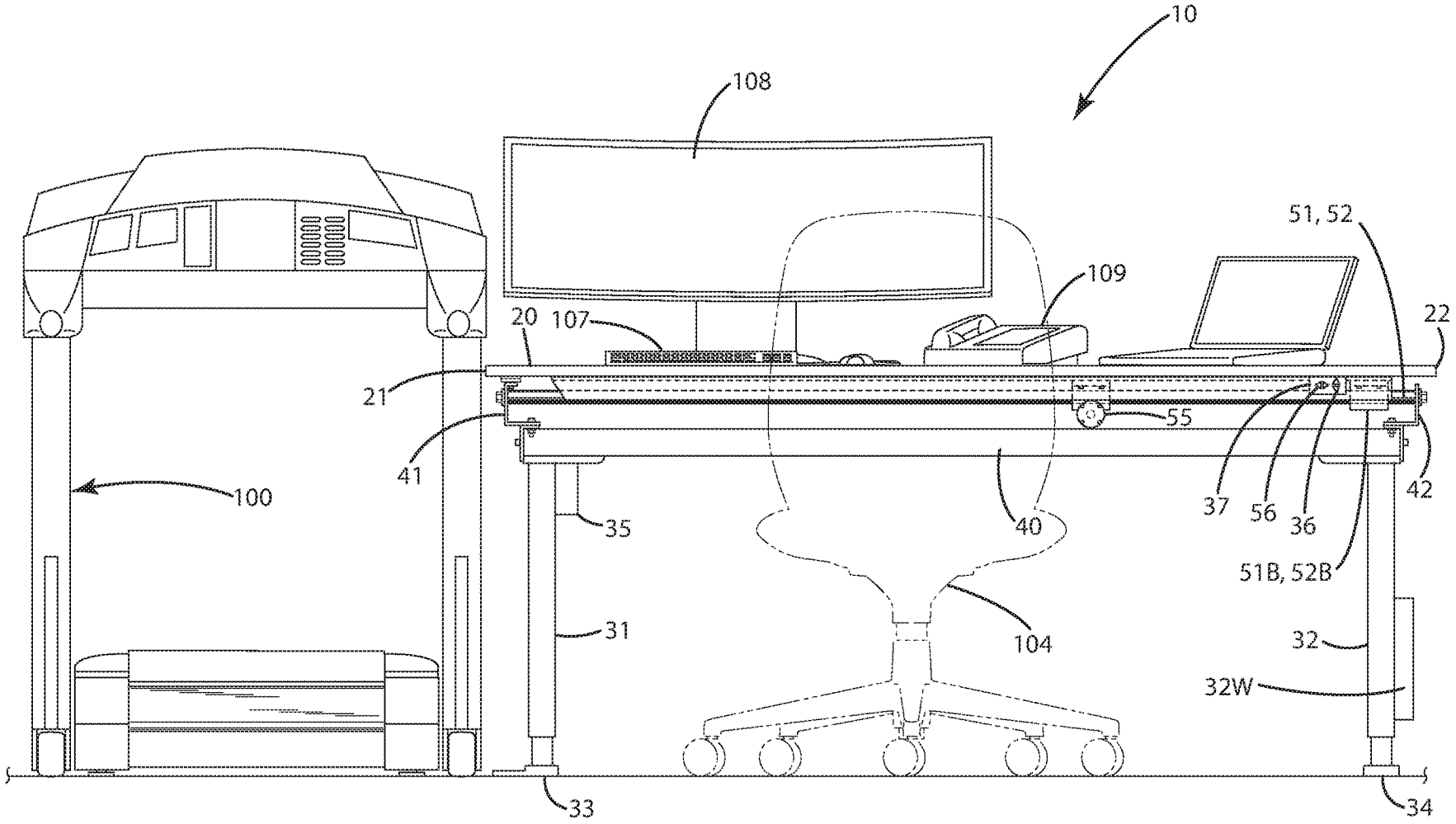
FIG. 3 is a perspective view of the workstation in a lowered third mode.

A current embodiment of the workstation is shown in FIGS. 1-3 and generally designated 10. The workstation 10 is shown in those figures with a desktop 20 in several positions relative to a piece of exercise equipment 100, which as shown is a treadmill, but can be virtually any other exercise equipment, such as an exercise bike, an elliptical, a stair stepper, a hip swayer or the like. The second or cantilevered position shown in FIG. 1 shows the desktop 20 disposed over the equipment in a cantilevered manner so that a user can use the work surface and any items on it, such as a keyboard 107, monitors 108, phone 109 or the like while performing exercise activity on the treadmill. The cantilevered position is also an elevated position so that the desktop 20 is greater than two or three feet off the ground. The desktop 20 can be moved relative to the support columns 31 and 32 to a first position shown in FIG. 2. That position can correspond to the desktop being disposed vertically above the first and second support columns 31 and 32, such that the first and second edges 21 and 22 of the desk are equal distanced from the respective first and second columns. In this positon, the user can stand facing the desktop to engage items on it. The workstation also can be lowered vertically to a third position shown in FIG. 3 so that a user, seated on a chair 104 can sit with legs under the desktop 20 and use the work surface and any items on it. The desktop is thus vertically and horizontally or laterally moveable relative to the support columns depending on the preference of the user at the station 10.

Figure 4:
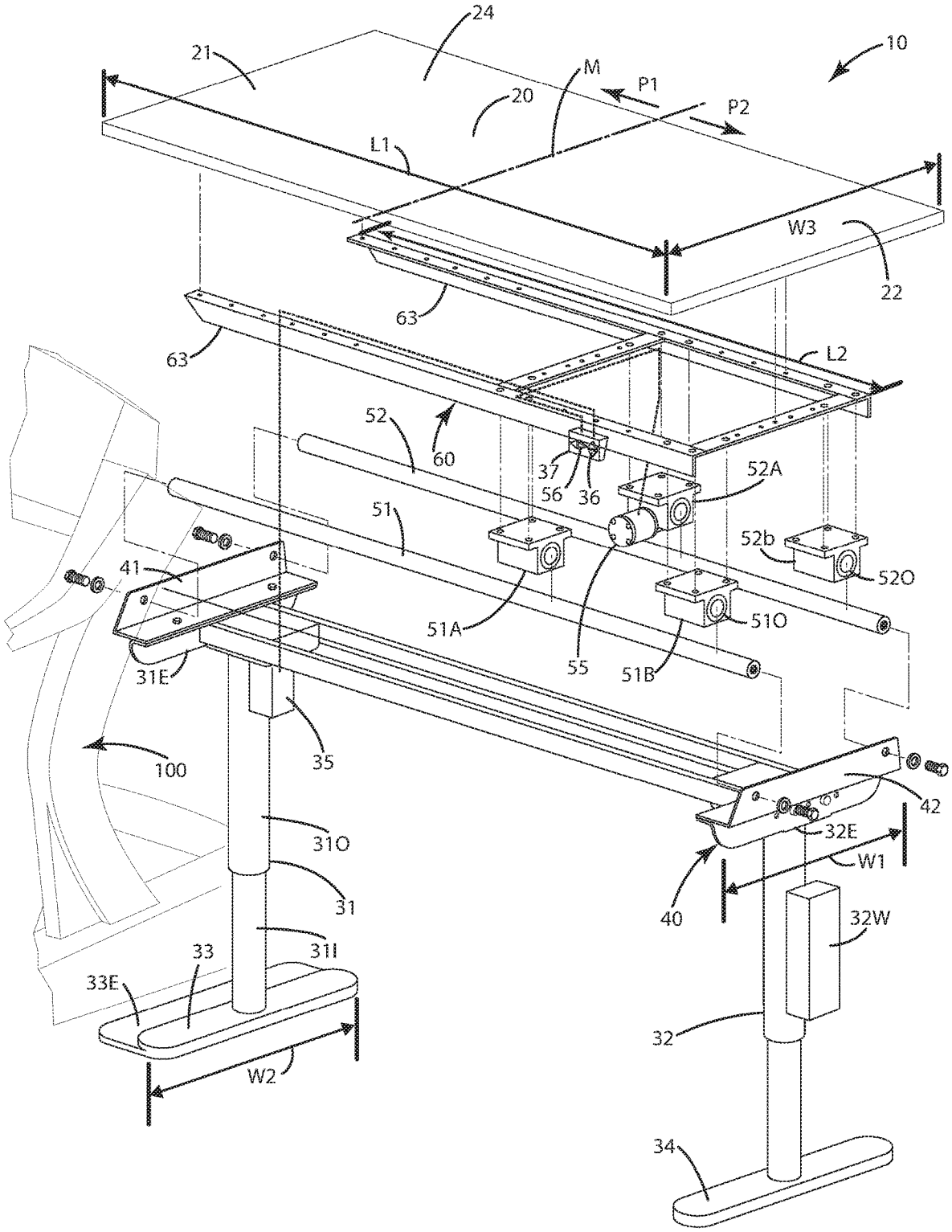
FIG. 4 is an exploded view of the workstation.
Figure 5:
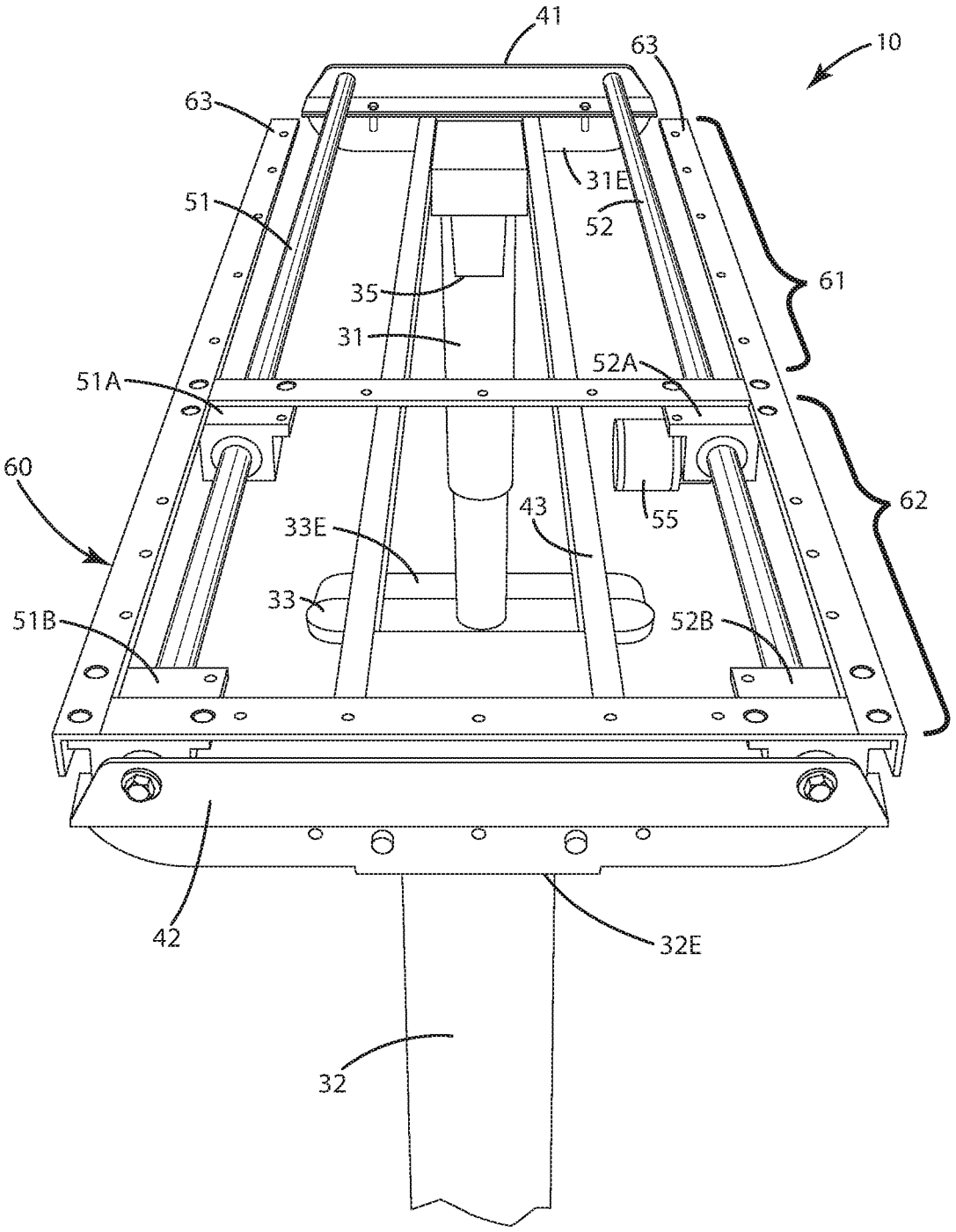
FIG. 5 is a side perspective view of the workstation showing the work surface frame and linear actuators.

With reference to FIGS. 4 and 5 components of the workstation 10 will now be described in more detail. The workstation can generally include a first support column 31 and a second support column 32. These columns can form vertical legs for the station, and can support the desktop 20 in any of the positions described herein. The columns 31 and 32 can each include a base or foot 33 and 34, respectively, secured to the lower portions of the columns. These base or feet can each have a width W2. This width can be between 75% and 100%, inclusive, the overall width or depth W3 of the desktop. The width W2 in most cases can be less than the width W3 so that the columns have a generally small footprint. The bases can extend forward and rearward of the respective columns to provide corresponding stability to the columns to hold up the desktop. In some cases, the base 33 can include a stabilizing extension 33E extending laterally away from the first support column 31 and away from the second support column 32 as well to counterbalance the desktop when the desktop is in the cantilevered position shown in FIG. 1. This extension can be at least 4 inches, at least 6 inches, at least 8 inches, at least 10 inches, or other lengths depending on the application and weight of the cantilevered desktop.

The first and second support columns 31 and 32 optionally can be constructed as fixed length columns, or as telescoping columns as shown comparing FIGS. 2 and 3. When in the form of telescoping columns, the columns can each include, for example, an inner tube or post 311 and an outer tube or post 310. These posts can telescope relative to one another so that they can extend and retract relative to one another and/or additional optional posts or tubes. One or both of the posts can be joined with an actuator 35, which, as used herein, can be any type of a linear actuator, a solenoid actuator, a scissor actuator, a jack screw, a screw actuator, a geared actuator, a magnetic actuator, a pneumatic actuator, a hydraulic actuator or any other type of actuator that facilitates movement of the desktop relative to the support columns. The actuator can be motorized, electrical and/or manual depending on the application. When the actuator is a motorized actuator, the height of the support columns 31 and 32 can be adjusted without a user manually applying an upward force to move the desktop.

The actuator can be controlled and operated by a vertical controller 36 which can be mounted to the desktop 20 or adjacent it, or somewhere on the station 10. The controller 36 can be a button, toggle or switch that is included in or joined with a mount or general control 37 on the desktop or elsewhere on the station 10. Optionally, additional features, such as biasing members, springs, cushions or dampening elements can be disposed between the outer 310 and inner 311 elements of the support columns, or any two parts of those columns. These elements can enable the support columns to be in either a "locked" or "unlocked" state. When in the "unlocked" state, the elements can assist with the raising and lowering of the desktop 20.

Each of the first and second support columns 31 and 32 can include upper ends 31E and 32E. As shown in FIGS. 4 and 5, these ends can be joined with a base frame 40. The base frame can include a first base end 41 and a second base end 42. To which the columns are bolted, fastened and/or welded. The base frame can include primary support beam 43 extending from one end to the other, between the support columns. The beam can be of a fixed length, and can be rigidly secured to the ends. The actuator 35 can be mounted to the beam, near an end as shown, or in other locations.

The workstation 10 can include a linear rail assembly 50 that can be joined with the base frame 40 and the desktop 20. As shown in FIGS. 1, 4 and 5, the linear rail assembly 50 can include a first elongated rail 51 and a second elongated rail 52. These rails can be optionally solid steel bars or cylinders, but of course can be in different forms and constructed from different materials. The ends of these rails 51 and 52 can mount directly to the first and second ends 41 and 42 of the base frame, secured there with fasteners, welds, or other securing structures. The rails can extend the length L2 of the base frame, from one end to the other. The rails can be substantially parallel, and can be of the same length. Although shown as including two rails, additional rails can be used, or the rails can be reduced to a single large or wide rail. The rails can be in the form of heavy steel cylinders, optionally weighing about as much as the desktop itself in some cases. In other cases, the rails can weigh optionally at least 80%, at least 70%, at least 60%, at least 50% of the desktop 20 and/or a desktop frame 50 which can be interposed between the rails and the desktop to provide additional support and rigidity to a lighter, thinner desktop in certain applications.

The linear rail assembly can include first 51A and third 52B rail mounts mounted to the first rail 51 and second 52A and fourth 52B rail mounts mounted to the second rail 52. Each of the mounts can be configured to slide and move relative to the respective rails in a generally linear manner, along those rails. Optionally, however, the mounts do not rotate relative to the rails during such sliding and/or movement. As shown, each of the rail mounts can include a generally cylindrical bore 51O and 52O through which a respective first 51 or second 52 rail can fit. The bores and mounts in general can circumferentiate the outer diameter or dimension of the respective rails or bars. In this manner, these mounts can transfer both downward forces or weights from the desktop to the rails, as well as upward forces or weights from the desktop to the rails when the desktop is in a cantilevered position. Thus, the rail mounts can hold onto and maintain contact with the rails, such that the desktop does not teeter or fall off the rails even when the desktop is cantilevered. The rail mounts further can be laid out in a quadrilateral, rectangular or square configuration, with one, two or more mounts on the first rail, and one, two or more mounts on the second rail. The rail mounts also can be configured so that they are disposed under the desktop between the middle or centerline M of the desktop and the second support column 32 when in the first position, but so that they are disposed closer to the first support column 31 when the desktop is in the second position over at least part of the exercise equipment.

The linear rail assembly also can include an actuator, optionally a motorized actuator 55, that selectively extends the desktop to the second position from the first position and retracts the desktop from the second position to the first positon or positions therebetween. The motorized actuator 55 can include rollers, bearings, wheels, gears or bushings integrated into one or more of the rail mounts and can engage the rail or base frame to provide motion. The actuator can be any type of a linear actuator, a solenoid actuator, a scissor actuator, a jack screw, a screw actuator, a geared actuator, a magnetic actuator, a pneumatic actuator, a hydraulic actuator or any other type of actuator that facilitates movement of the desktop relative to the support columns. The actuator can be motorized, electrical and/or manual depending on the application. When the actuator is a motorized actuator, the desktop can be horizontally slid or moved relative to the support columns 31 and 32.

The actuator 55 can be controlled and operated by a horizontal controller 56 which can be mounted to the desktop 20 or adjacent it, or somewhere on the station 10. The controller 56 can be a button, toggle or switch that is mounted to a general control 37 on the desktop or elsewhere on the station 10. The user can manually engage this controller 56 to move the desktop to the first position or the second position. Optionally, the controller 56 can be located beyond the middle line M of the desktop, in the half of the desktop distal from the exercise equipment 100 when the workstation is placed adjacent the same. This way, the user can move the desktop over the equipment before entering or mounting the equipment. The user also can stand laterally of the exercise equipment the entire time the desktop is being moved to the second position in which it is cantilevered.

Further optionally, the first and second actuators 35 and 55 can be separate motorized actuators, wired separately to their controllers and to a power source, such as a wall plug or other electric input. In some cases, however, these actuators can be combined into one so that a single actuator can facilitate both the vertical and horizontal movements of the desktop and station in general. In other cases, the actuators can be replaced with manual actuators or deleted, so the user can manually move the desktop and station components up and down, and/or sideways to the cantilevered position.

The actuator 55 can engage the rail and mount so that the desktop slides along the rails, generally moving laterally in direction P1 to the second positon shown in FIG. 1, or in direction P2 to the first position. The actuator can include a lock such that when the desktop 20 is in the first or second position, the mounts or desktop can no longer move relative to the rails or the base frame 40. Optionally, where the actuator 55 is a motorized actuator, when it ceases movement, it effectively locks the desktop in position, arresting its further movement, without further intervention or adjustment or manual locking by a user. Further optionally, the desktop can be locked in at least one of the first position and the second position when the actuator is not powered, or when it is in a locked mode. Thus, with the motorized actuator, the desktop will remain secured in the first or second positions, or other positions there between.

In some cases, the desktop can be constructed from a thinner or weaker material, in which case it can be bolstered with a desktop support frame 60 joined with a lower surface of the desktop 20. The desktop support frame can include a first portion 61 and a second portion 62, which generally can be located in opposing parts across the middle or centerline M of the desktop. The second portion 62 can be joined directly to the rail mounts, for example, it can be mounted to and supported by the first rail mount, second rail mount, third rail mount and fourth rail mount, which are themselves slidably mounted on the respective rails 51 and 52. The first portion 61 of the desktop support frame extends away from the second portion 62 in a cantilevered manner even while the desktop and desktop support frame are in the first position and directly over the first and second support columns, for example as shown in FIGS. 4 and 5.

Optionally, the distal end 63 of the desktop support frame, the first portion 61 and end 21 of the desktop can be free from support under the same all the way to the middle line M of the desktop, or farther, so that those elements, or only the desktop where the desktop is directly joined with the rail mounts, are cantilevered and supported by the second portion. Further optionally, the first portion of the desktop support frame extends away from the second portion in a cantilevered manner even while the desktop is in the first position over the first and second support columns. In such a construction, the desktop 20 and its frame 60 can be configured so that when the desktop is in the position for sitting or standing shown in FIGS. 2 and 3, the desktop beyond the centerline M and first portion 61 of the frame 60 are cantilevered beyond the rail mounts. In this position, the desktop and its frame can be cantilevered over the first support column 31 and/or the base frame 40 adjacent the first support column 31.

When the desktop is extended laterally from the base frame 40 in the second position for exercise activity shown in FIG. 1, the desktop 20 and its frame 60 extend laterally beyond the first support column and/or the frame end 41 a distance D1. This distance D1 can be optionally greater than 50%, greater than 60%, greater than 70%, or greater than 80% of the length L1 of the desktop. In this cantilevered position, optionally greater than 50%, greater than 60%, greater than ⅔, greater than 70%, or greater than 80% of the desktop length extends laterally beyond in a cantilevered manner the first column support when the desktop is in the second position. Further optionally, less than 50%, less than 40%, less than ⅓, less than 30%, or less than 20% of the desktop length L1 is disposed between the first support column and the second support column when the desktop is in the second position. In this cantilevered position, the desktop and frame, and in particular the first portion 61 and part of the second portion 62 that does not extend beyond the rail mounts, can be cantilevered and suspended in an extended configuration beyond the end 41 of the base frame 40 and the first support column 31. The mass M1 of the desktop and its frame 60 exert a moment about a fulcrum near the first column 31 and/or the end 41, however, due to the mass M2 of the remainder of the workstation including the rails 51 and 52 being much greater than that moment, the cantilevered desk is significantly impaired from tipping and is surprisingly stable. In addition, optionally the foot extension 33E can further impair such misbalance. In some cases, extra weight 32W optionally can be added to the second support column to impair tipping.

Operation and use of the workstation 10 will now be described with reference to FIGS. 1-3. In general, the workstation 10 can include the components mentioned above, such as a first vertically telescoping support column 31, a second vertically telescoping support column 32, a base frame 40 mounted atop the first and second support columns and a desktop 20 joined with the base frame 40. The station can start with the desktop in the first position of FIG. 2 or the third position of FIG. 3, if the station includes that optional third position capability.

The third positon can be configured so that a chair or seat 104 can be disposed at least partially under the desktop and frame, and between the first and second support columns 31 and 32. The space between the first and second columns as shown, however, is inadequate to accept both the chair and the equipment 100, which is set outside and laterally of the support columns. Again, this can reduce the overall footprint of the station 10, because it optionally need not be wide enough to accommodate both the equipment 100 and chair or seat. From the third positon shown in FIG. 3, a user can operate the station with controller 37. In particular, the user can actuate the input 36, which in turn can operate and power the actuator 35 to raise the desktop 20 to the second positon shown in FIG. 2. This can occur with the first and second supports telescoping and extending along their lengths to raise the height of the desktop.

With the workstation 10 in the first positon shown in FIG. 2 (or some vertical position between a lowered position and that one), the user can sit or stand facing the desktop, and can remove the chair or replace it with a taller chair or stool in some cases.

If the user desires to use the workstation and exercise on a piece of exercise equipment 100, the user generally can operate the station 10 to slide from the first position in which the desktop is disposed vertically over both the first and second support columns as shown in FIG. 2, to the second position shown in FIG. 1, in which the desktop is cantilevered and projects laterally, distally beyond the first support column a first distance beyond the base frame, so that the user can exercise facing the desktop on an exercise device located laterally beyond and outside the first and second column supports. This sliding movement optionally can be void of any turning or rotation of the desktop or base frame relative to the support columns or other components of the workstation. The sliding can be a linear motion where the desktop and its frame linearly slide or move along the rails 51, 52, as described above, to the extended position or some intermediate position between that shown in FIG. 2 and FIG. 1.

The sliding or linear movement of the desktop can occur without the user moving or reorganizing any of the items 107, 108, or 109 on the desktop or the work surface atop the desktop. In this manner, a user can move from a standing positon to the position on the exercise equipment seamlessly and without much effort.

As mentioned above, the sliding action can occur to move the desktop to the cantilevered configuration. The movement of the desktop can be done manually, by the user unlocking a lock, such as a simple pin between the rail mounts and frame (not shown) in the second positon and moving the desktop to slide the rail mounts along the rails to achieve the cantilevered position of the desktop as shown in FIG. 1. When in that position, the user can manually lock again the desktop relative to the base frame and legs to maintain a fixed position. The lock can be another pin as mentioned above, or some other type of lock.

Where the station includes the motorized actuator 55, the user can actuate the input 56, which in turn can operate and power the actuator 55. The actuator can engage the rails and/or mounts, or other parts associated with the desktop, which in turn propels the desktop laterally, so that the desktop 20 moves to the extended and cantilevered position. When the power to the actuator ceases, the desktop frame and desktop cease movement and effectively are secured in place along the rails so that they do not extend or retract until the actuator is powered again. This can prevent or impair the inadvertent movement of the desktop when in the extended mode. The user can then engage in exercise activity on the equipment 100, with the desktop in the elevated and cantilever position, and with the items on the workspace in the same location as when the desktop was in the second positon.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

What is claimed is:

1. A workstation comprising:

a first support column extending upwardly to a first column upper end, the first support column being a telescoping column selectively extendable in length;

a second support column extending upwardly to a second column upper end, the second support column being another telescoping column selectively extendable in length;

a base frame having a first base end joined with the first column upper end and a second base end joined with the second column upper end;

a linear rail assembly joined with the base frame, the linear rail assembly including a first rail mount slidably joined with a first elongated rail, the linear rail assembly being fixedly secured to the base frame; and a desktop mounted to the first rail mount and slidable between:

a first position in which the desktop is disposed vertically over both the first and second support columns, and is configured so that a user can sit or stand facing the desktop at a location between the first and second support columns; and a second position in which the desktop is cantilevered and projects laterally, distally beyond the first support column a first distance beyond the base frame, and is configured so that the user can exercise facing the desktop on an exercise equipment located laterally beyond and outside the first and second support columns a desktop support frame joined with a lower surface of the desktop, wherein the desktop support frame is mounted to the first rail mount, wherein the desktop support frame includes a first length, wherein less than 50% of the first length is disposed between the first support column and the second support column when the desktop is in the second position.

2. The workstation of claim 1 comprising:

a second elongated rail mounted adjacent and parallel to the first elongated rail; and a second rail mount slidably joined with the second elongated rail, wherein the desktop is joined with the second rail mount.

3. The workstation of claim 2 comprising:

a third rail mount slidably joined with the first elongated rail; and a fourth rail mount slidably joined with the second elongated rail, wherein the desktop is joined with the third and fourth rail mounts.

4. The workstation of claim 3, wherein the linear rail assembly includes a motorized actuator configured to selectively move the desktop to the first position from the second position and vice versa.

5. The workstation of claim 1, wherein the linear rail assembly includes a first motorized actuator configured to selectively extend the desktop to the second position from the first position.

6. The workstation of claim 5 comprising:

a second motorized actuator joined with at least one of the first and second support columns to selectively raise the desktop, from a lowered position to a raised position.

7. The workstation of claim 1, wherein the desktop includes a desktop length, wherein greater than 50% of the desktop length extends laterally beyond the first support column in a cantilevered manner when the desktop is in the second position, wherein less than 50% of the desktop length is disposed between the first support column and the second support column when the desktop is in the second position.

8. The workstation of claim 1, wherein the desktop includes a desktop length, wherein greater than ⅔ of the desktop length extends laterally beyond the first support column in a cantilevered manner when the desktop is in the second position, wherein less than ⅓ of the desktop length is disposed between the first support column and the second support column when the desktop is in the second position.

9. The workstation of claim 1, wherein the first support column includes a base with an extension extending laterally away from the first support column and away from the second support column to counterbalance the desktop when the desktop is in the second position.

10. A workstation comprising:

a first support column extending upwardly to a first column upper end, the first support column being a telescoping column selectively extendable in length;

a second support column extending upwardly to a second column upper end, the second support column being another telescoping column selectively extendable in length;

a base frame having a first base end joined with the first column upper end and a second base end joined with the second column upper end;

a linear rail assembly joined with the base frame, the linear rail assembly including a first rail mount slidably joined with a first elongated rail, the linear rail assembly being fixedly secured to the base frame; and a desktop mounted to the first rail mount and slidable between:

a first position in which the desktop is disposed vertically over both the first and second support columns, and is configured so that a user can sit or stand facing the desktop at a location between the first and second support columns; and a second position in which the desktop is cantilevered and projects laterally, distally beyond the first support column a first distance beyond the base frame, and is configured so that the user can exercise facing the desktop on an exercise equipment located laterally beyond and outside the first and second support columns;

a desktop support frame joined with a lower surface of the desktop, the desktop support frame including a first portion and a second portion;

a second elongated rail mounted to the base frame adjacent and parallel to the first elongated rail;

a third rail mount slidably joined with the first elongate rail; and a second rail mount and a fourth rail mount slidably joined with the second elongated rail, wherein the second portion of the desktop support frame is joined with and supported by the first rail mount, second rail mount, third rail mount and fourth rail mount, wherein the first portion of the desktop support frame extends away from the second portion in a cantilevered manner even while the desktop is in the first position over the first and second support columns.

11. The workstation of claim 10, wherein the first rail mount, second rail mount, third rail mount and fourth rail mount each include a bore through which the respective first and second elongated rails extend, each rail mount fully surrounding each of the respective first and second elongated rails.

12. The workstation of claim 10, wherein each of the first and second elongated rails are cylindrical bars extending a length of the base frame.

13. A workstation comprising:

a first vertically telescoping support column;

a second vertically telescoping support column;

a base frame mounted atop the first and second support columns, so that the base frame is movable up and down;

a desktop joined with the base frame and slidable between:

a first position in which the desktop is disposed vertically over both the first and second support columns, and is configured so that a user can sit or stand facing the desktop at a location between the first and second support columns; and a second position in which the desktop is cantilevered and projects laterally, distally beyond the first support column a first distance beyond the base frame, and is configured so that the user can exercise facing the desktop on an exercise device located laterally beyond and outside the first and second support columns;

a linear rail assembly joining the base frame and the desktop, the linear rail assembly including a first rail mount fixedly joined with the desktop and slidably joined with a first elongated rail extending through the base frame; and a motorized actuator joined with the linear rail assembly and configured to move the desktop from the second position to the first position;

a desktop support frame joined with a lower surface of the desktop, the desktop support frame including a first portion and a second portion;

a second elongated rail mounted to the base frame adjacent and parallel to the first elongated rail;

a third rail mount slidably joined with the first elongate rail; and a second rail mount and a fourth rail mount slidably joined with the second elongated rail, wherein the second portion of the desktop support frame is joined with and supported by the first rail mount, second rail mount, third rail mount and fourth rail mount, wherein the first portion of the desktop support frame extends away from the second portion in a cantilevered manner even while the desktop is in the second first position over the first and second support columns.

14. The workstation of claim 13, wherein the motorized actuator moves the desktop when the actuator is powered, but prevents movement of the desktop when the actuator is not powered, whereby the desktop is locked in at least one of the first position and the second position when the actuator is not powered.

15. The workstation of claim 13, wherein the desktop includes a desktop length, wherein greater than 50% of the desktop length extends laterally beyond in a cantilevered manner the first support column when the desktop is in the second position, wherein less than 50% of the desktop length is disposed between the first support column and the second support column when the desktop is in the second position.

* * * * *